United States Patent [19]

Didion

[11] Patent Number: 4,674,691

[45] Date of Patent: Jun. 23, 1987

[54] DUAL SAND RECLAIMER

[75] Inventor: Charles J. Didion, St. Charles, Mo.

[73] Assignee: Didion Manufacturing Company, St. Peters, Mo.

[21] Appl. No.: 791,170

[22] Filed: Oct. 24, 1985

[51] Int. Cl.[4] ..... B02C 17/02

[52] U.S. Cl. ..... 241/8; 241/97; 241/181; 241/152 A; 241/DIG. 12; 51/164.1

[58] Field of Search ..... 51/164.1; 164/131, 401, 164/404; 209/288, 297, 372; 241/14, 24, 29, 74, 80, 97, 171, 181, DIG. 10, 152 R, 152 A, 178

[56] References Cited

U.S. PATENT DOCUMENTS

| | | |
|---|---|---|
| 677,691 | 7/1901 | Packer . |
| 788,675 | 5/1905 | Rissmuller . |
| 1,017,946 | 2/1912 | Beneke . |
| 1,090,326 | 3/1914 | Michaelsen . |
| 1,120,343 | 12/1914 | Spaulding . |
| 1,156,394 | 10/1915 | Crowe . |
| 1,217,351 | 2/1917 | Schwarz . |
| 1,524,871 | 2/1925 | Lindhard . |
| 1,552,694 | 9/1925 | Groebe . |
| 1,587,653 | 6/1926 | Kennedy et al. . |
| 1,614,899 | 1/1927 | Read . |
| 1,683,627 | 9/1928 | Read . |
| 1,710,666 | 4/1929 | Newhouse . |
| 1,743,833 | 1/1930 | Stall . |
| 1,765,291 | 6/1930 | Titgen . |
| 1,768,570 | 7/1930 | Clark . |
| 2,131,260 | 9/1938 | Temple . |
| 2,188,798 | 1/1940 | Smith . |
| 2,189,711 | 2/1940 | Eigenbrot . |
| 2,286,132 | 6/1942 | Walle . |
| 2,299,032 | 10/1942 | Ransohoff . |
| 2,321,016 | 6/1943 | De Back . |
| 2,323,696 | 2/1941 | Earle . |
| 2,331,135 | 10/1943 | Ovestrud . |
| 2,351,453 | 6/1944 | Pearl . |
| 2,359,944 | 10/1944 | Schummer . |
| 2,523,258 | 9/1950 | Ransohoff . |
| 2,539,973 | 1/1951 | Ransohoff . |
| 2,721,035 | 10/1955 | Lankford et al. . |
| 2,739,427 | 3/1956 | Ransohoff . |
| 2,821,375 | 1/1958 | Andrews . |

(List continued on next page.)

FOREIGN PATENT DOCUMENTS

| | | |
|---|---|---|
| 117708 | 11/1943 | Australia . |
| 293262 | 6/1966 | Australia . |
| 900466 | 2/1968 | Australia . |
| 442883 | 4/1972 | Australia . |
| 1220976 | 7/1966 | Fed. Rep. of Germany . |
| 2245664 | 4/1974 | Fed. Rep. of Germany . |
| 1449405 | 2/1970 | France . |
| 2167308 | 8/1973 | France . |
| 161977 | 12/1929 | United Kingdom . |
| 807711 | 1/1959 | United Kingdom . |
| 916081 | 1/1963 | United Kingdom . |
| 1219427 | 1/1971 | United Kingdom . |
| 1261045 | 1/1972 | United Kingdom . |

OTHER PUBLICATIONS

Teunissen, W., Foundry Trade Journal, "Hot Sand", Apr. 1972.

Didion, Didion RLC-10, 12-14-81.

Foundry & Technical Liaison Ltd, pp. 1, 4, 5.

*Primary Examiner*—timothy V. Eley

*Attorney, Agent, or Firm*—Paul M. Denk

[57] ABSTRACT

A dual sand reclaimer comprising a drum formed of an inner and outer cylinder, substantially along its length, the drum being formed into three segments, an entrance segment wherein the castings are initially deposited for removal of its green mold sand, the inner cylinder thereat being perforated to provide for separation of the sand from its castings, a middle segment wherein the castings and internally arranged mold sand are subjected to abrasive members that remove any core sand, and a third or discharge segment from which the castings exit, and having an inner cylinder thereat perforated to provide for the passage of the core sand and abrasive members therethrough, with the sand being screened for removal thereat, while the abrasive members are returned by vanes arranged intermediate the inner and outer cylinders of the middle segment of the drum for a return to the leading end of the segment for reusage.

11 Claims, 5 Drawing Figures

U.S. PATENT DOCUMENTS 2,933,861 4/1960 Bintzler .
2,955,305 10/1960 Jooss et al. .
3,388,478 6/1968 Vissers .
3,585,758 6/1971 Harper .
3,690,068 9/1972 Coss et al. .
3,848,815 11/1974 Carpenter, Jr. et al. .
3,862,719 1/1975 Muller .
3,871,438 3/1975 Vissers et al. .
3,897,910 8/1975 Deve .
3,942,644 3/1976 Vissers .
3,998,262 12/1976 Didion .
4,008,856 2/1977 Sears .
4,050,635 9/1977 Mueller et al. .
4,274,360 6/1981 Hofmann et al. .

DUAL SAND RECLAIMER

BACKGROUND OF THE INVENTION

This invention relates generally to a multi-cylinder formed drum for use for reclaiming select and distinct quantities of molding sand of the type used in the formation of a mold for the casting of iron and other metal parts.

Various types of tumbling devices or mechanisms for use for removing mold sand from castings, or even for separating other deleterious particles or fragments from castings or other metal parts have long been available in the art. For example, a prior patent to the inventor of this current development entitled "Casting Shake-Out Unit and Method of Operation" clearly discloses one apparatus for attaining a separation of loosened mold sand from the tumbled castings deposited therein, as can be readily observed from U.S. Pat. No. 3,998,262, issuing to C. J. Didion. The particular apparatus described and disclosed therein has operated highly satisfactory for providing generalized loosening of mold sand from their just previously cast metal parts. In addition, the United States patent to Mueller, U.S. Pat. No. 4,050,635, discloses another type of tumbling device which is designed for removing and reclaiming sand from the foundry molds and forms, generally indicating how the surface mold sand can be removed by exposing the just cast part to tumbling within a specially designed apparatus.

Additional United States patents disclose various types of instruments for providing or aiding in the separation of sand from castings, or for functioning in the category of tumbling mills for removing sand from their molds, or for acting as deburring apparatus for removal of unwanted components from cast or milled metal parts. Such can be seen from the United States patents to Packer, U.S. Pat. Nos. 677,691, to Stall, 1,743,833, to Perl, 2,351,453, to Ransohoff, 2,523,258, in addition to Vissers, 3,388,478. In addition, select foreign patents such as the German patent No. 1,220,976, and the United Kingdom patent No. 807,711, disclose related devices.

Additional sand reclaiming devices or related apparatus are shown in the U.S. patent to Rissmueller, U.S. Pat. Nos. 788,675, to Spaulding, 1,120,343, in addition to Lindhard, 1,524,871.

Other patents disclosing apparatuses for tumbling components, function as a pulverizing machine, or comminuting mill are shown in the Read, U.S. Pat. Nos. 1,683,627; 1,710,666, to Newhouse; 3,942,644, to Vissers; 2,131,260, to Temple; 1,090,326, to Michaelsen; to Kennedy, 1,587,653; 2,189,711, to Eigenbrot; 2,721,035, to Langford, et al; 1,217,351, to Schwarz; 1,614,899, to Read; 2,286,132, to Walle; 1,156,394, to Crowe; 1,017,946, to Benneke; 1,552,694, to Groebe; 1,765,291, to Titgen; 1,768,570, to Clark; 2,188,798, to Smith; 2,232,696, to Earle; 2,299,032, to Ranshohoff; 2,321,016, to De Back; 2,331,135, to Ovestrud; 2,359,944, to Schummer; 2,539,973, to Ransohoff; 2,739,427, to Ransohoff; 2,821,375, to Andrews; 2,933,861, to Bintzler; 2,955,305, to Jooss et al; 3,585,758, to Harper; 3,690,068, to Coss et al.; 3,848,815, to Carpenter, Jr. et al.; 3,862,719, to Muller; 3,871,438, to Vissers et al; 3,897,910, to Deve; 4,008,856, to Sears; 4,274,360, to Hofmann et al.

Other foreign patents include the British patent specification No. 161,977, to Davidsen; British patent specification No. 916,081, to Bell Intercontinental Corp.; British patent specification No. 1,219,427 to Vissers; British patent specification No. 1,261,045, to Feterl; German patent No. DT 22 45 664; German patent No. 1,300,204; Dutch patent No. 323 771, Australian patent No. 117,708, to Wadley; Australian patent No. 9004/66 to General Electric Co., Ltd.; Australian patent No. 293,262 to Wool Processors Pty. Ltd., ; Australian patent No. 38,931/72 to Slade Gorton & Co., Inc.; French patent No. 2,296,484; French patent No. 1,449,405 to Vissers; and French patent No. 2,167,308.

In addition, a Company by the name of Foundry and Technical Liaison Ltd., of Great Britain, has manufactured and marketed a sand reclamation system incorporating a tumbling type mill incorporating lifter plates that lift and tumble sand lumps, apparently without any castings, for reducing the size of the sand down to a more usable form. A related type of lump crusher and sand reclaimer device has been marketed by the applicant herein, through his Company, Didion Manufacturing Co., and which device incorporated a grading segment, a crushing segment, a lifter segment, and a screening segment, all for simply reclaiming sand, but after the sand had been previously removed from their castings, or from the molds, with this apparatus acting for the purpose of independently finely granulating the casting sand for reusage.

In view of the foregoing, it must be stated that the current invention has as its principal purpose the removal of casting sand that yet clings upon the cast parts, whether such sand be adhered superficially to the cast part, or arranged within its internal apertures, in order that the different types of mold sand can be removed, and reasonably segregated as to to the type of sand employed, for ready in preparation for reusage.

Another object of this invention is to provide for the removal of distinct types of sand from cast iron castings so as to not only prepare the castings for further working, but to have the distinct types of sand reasonably reclaimed for reusage.

Another object of this invention is to provide a rotary shake-out dual sand reclaiming unit wherein the clay mold sand and the core sand can be reasonably separately reclaimed for further usage by the foundry.

Another object of this invention is to provide a sand reclaiming device that is built significantly sturdy in its structure, so that it can handle heavy cast parts even in the category of engine blocks, and the like.

Still another object of this invention is to provide a sand reclaiming unit where certain segments incorporate the standard and prior art type of abrasive members that have a tendency to scrub clean the castings passing therethrough, but likewise to enter into the interior of any cast part and to remove the mold sand even therefrom.

Still another object of this invention is to provide means for removing all of the mold sand from a cast part, whether said mold sand be surface adhered or internally confined, all within a single and integrated dual functioning reclaimer apparatus.

Still another object of this invention is to provide a sand shake out and reclaimer unit that is automatic of operation, and eliminates the need for any human participation during its normal and routine functioning.

These and other objects will become more apparent to those skilled in the art upon reviewing the summary of this invention, and upon undertaking a study of the description of the preferred embodiment, in view of the drawings.

SUMMARY OF THE INVENTION

This invention contemplates the formation of a rotary shake out device designed, as previously explained, to furnish a separation of that residue sand from its just previously cast part. For example, in the molding of cast iron parts, as is readily and has long been know, mold sand is utilized for providing a particular shaped mold into which the molten cast iron is poured for providing a component as needed for a variety of applications within most segments of industry. In the formation of such a mold, and also which is well known, particular types and grades of sand are employed in the formation of the molds themselves. For example, for the general overall outline and shape of the external aspects of any part to be casts, generally a type of clay mold or green sand is employed, and which is prepared by the craftsman, or perhaps even mechanically performed this date, in furnishing the overall external configuration for the part to be molded. On the other hand, where internal chambers, cylinders, or the like, are required, within the intended cast part, a special type of sand is utilized, generally combined with particular chemicals to provide for its adhesion or adherence together, so that when the mold is formed, these internal chambers will be reasonably formed during the casting process, and that a fracture or failure of the molded internal components does not fail, which would lead towards the casting of an imperfect part, requiring rejection. On the other hand, the sand as utilized for formation of these internal features of a part to be cast is of a more expensive quality, usually, as previously explained, requiring chemical additives for assuring that the sand functions properly, and does not fail during the casting process. As a result, it is highly desirable to obtain a reclamation of this particular type of mold sand, for retreatment and reusage, and it is the style of apparatus as invented herein which is intended to provide for the salvage of such a mold sand for reapplication. On the other hand, it cannot be gainsaid that the standard clay or green sand likewise is desired for reclamation, and therefore, the structure of this current shake-out unit is intended to provide reasonably discrete or separate dual removal of the various mold sands from any casting passing through the apparatus, and for their separate collection in preparation for reusage.

The structure of this current invention includes a drum means, supported by a base member, with the base member incorporating the required bearings for providing a reduced frictional rotation of the drum upon the same, while further embodying the drive means, such as a motor, or the like, for affording that moderate rotation for the drum during its functioning.

The drum means of the apparatus includes a pair of cylinders, an outer cylinder having an inner and concentric cylinder arranged therein, with a vane means generally of the helical style being provided partially at select locations within the space intermediate these two cylinders, to provide for transfer of either the sand or other members during the apparatus functioning. The inner cylinder is constructed of a series of segments, the first segment comprising an entrance segment into which the castings are initially introduced into the apparatus, so that that surface clay mold or green sand normally adhering thereto, and which forms the basic exterior aspects of the mold, as previously explained, can be readily removed through tumbling of the cast parts therein. The inner cylinder incorporates means for effecting a gradual longitudinal shifting of the castings, down the length of the drum, and this can be provided through the application of rifling, or the like, upon the interior surface of the entrance segment. In addition, the entrance segment incorporates a series of perforations within or through its inner cylinder, so that while the green sand is removed, it readily falls through these openings and into that spacing where the helical vanes move said sand in a specified direction for disposal and collection for reusage.

The apparatus is further formed integrally, with a middle segment, generally comprising its inner cylinder having a series of riflings or other means for moving the castings further longitudinally thereof. In addition, this particular segment of the apparatus further incorporates a volume of abrasive members, not too unlike tumbling balls, but in this particular instance, comprising what is generally identified in the trade as ductile star members or burnishing members, which have a tendency to abrasively rub against the cast component, and enter into its internal cavities, as formed, for removing what is identified as the core or cling sand that previously had been used within the mold for forming the inner structural aspects that give rise to the apertures or internal chambers formed desirably of the cast component during its formation. The ductile stars or abrasive media are available from a variety of sources. For example, as can be seen from the patent drawings accompanying this disclosure, engine blocks are the items that had been molded from cast iron, and while it is relatively easy to remove the surface or green sand from the castings, as they move through the initial or first segment of the apparatus, attempting to clean and eliminate the core sand from within the internal interstices formed of the casting, such as where the piston cylinders are formed, or the cam shaft may be located at the downward portion of any block, has been rather difficult in the past, usually requiring manual services. But, through the combination of the rotary apparatus of this invention, including an ample quantity of star abrasive media therein, the core sand is readily cleaned and easily removed from the cast parts, and becomes intermingled with the abrasive members as they likewise move with the cast parts longitudinally along the apparatus during its functioning.

A third or exit segment of the apparatus is formed having a perforated inner cylinder, as can be seen, through which the abrasive members and the combined core sand falls, while the castings are moved by means of rifling, or the like, therefrom, and discharged or removed from the back end of the operating apparatus. The structured device includes means for initiating a return of the abrasive members and perhaps its combined core sand back towards the front of the apparatus, while separation of these two compenents readily occurs through the arrangement of a series of perforation provided through the outer cylinder, through which the core sand is allowed to be discharged, while the abrasive members being too large to pass through the outer cylinder apertures enter into the vaned spacing provided intermediate the inner and outer cylinders formed of the middle segment, and are returned to a housing provided between the first and middle segments, for transfer back into the middle segment, onto the surface of its inner cylinder, for reusage in aiding in the removal of the core sand from further deposited castings.

DESCRIPTION OF THE PREFERRED EMBODIMENT

Figure 1:
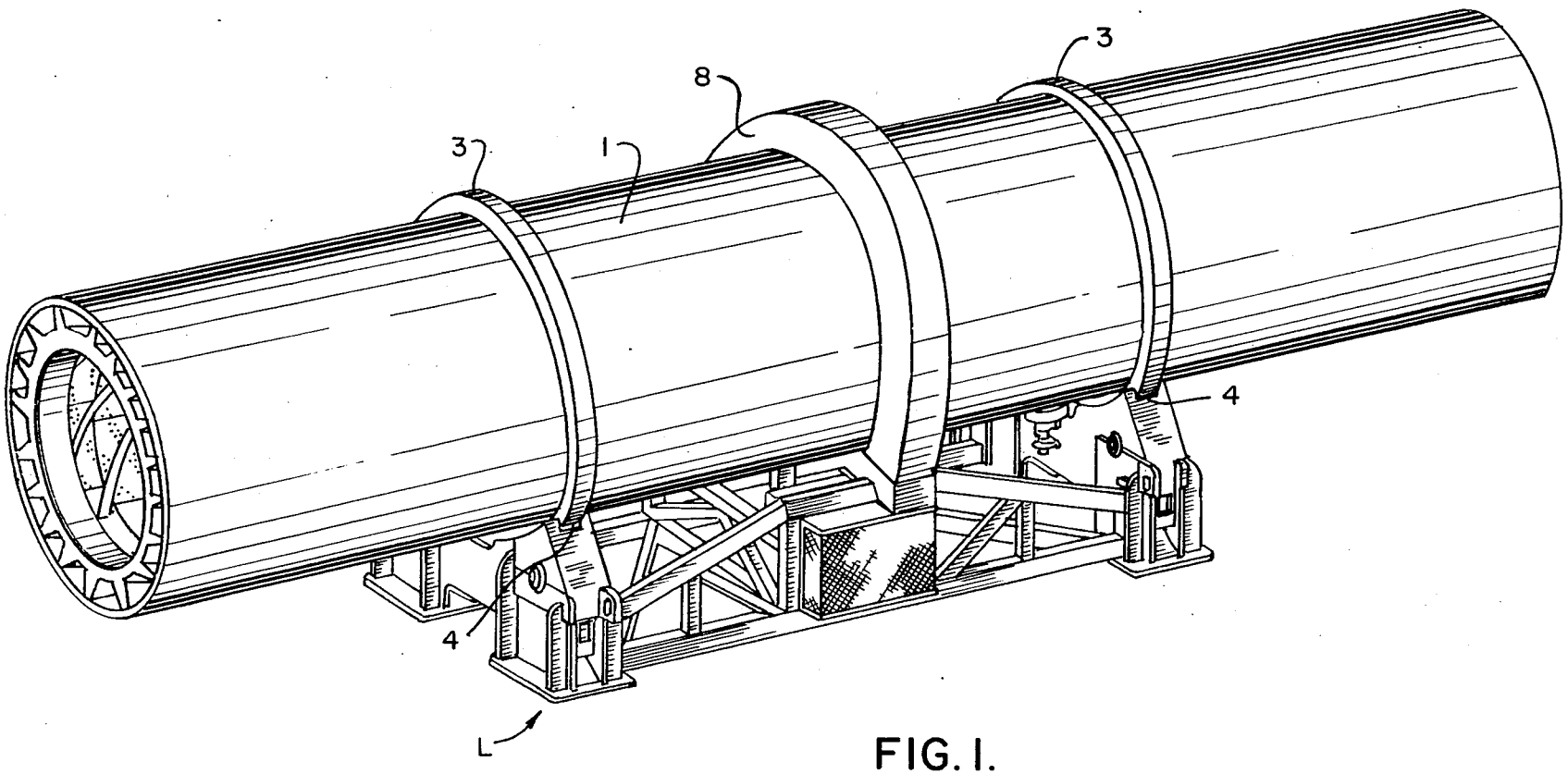
FIG. 1 provides an isometric view of the dual sand reclaimer of this invention.

In referring to FIG. 1, the dual sand reclaimer of this invention is disclosed. It comprises the drum means 1 mounted upon its base means 2 and disposed for rotation thereupon, through the riding of its integral tracks or races 3 upon bearings, generally provided as at 4; upon said base means. As can be seen further in FIG. 3, a drive means, such as a motor 5 and which may function in cooperation with a speed reducer, as at 6, provides for a turn of the rotary drum through an intergearing with the circumferential gear 7 of the drum means. See also FIG. 2. A cover, such as at 8, may provide enclosure for the gear means 7.

It is to be noted that the base means 2 is fabricated from a series of bracing, struts, and pads, in order to afford full stability for the support of this sand reclaimer during its operations, and to minimize any vibrations, or the like, during its usage.

Figure 2:
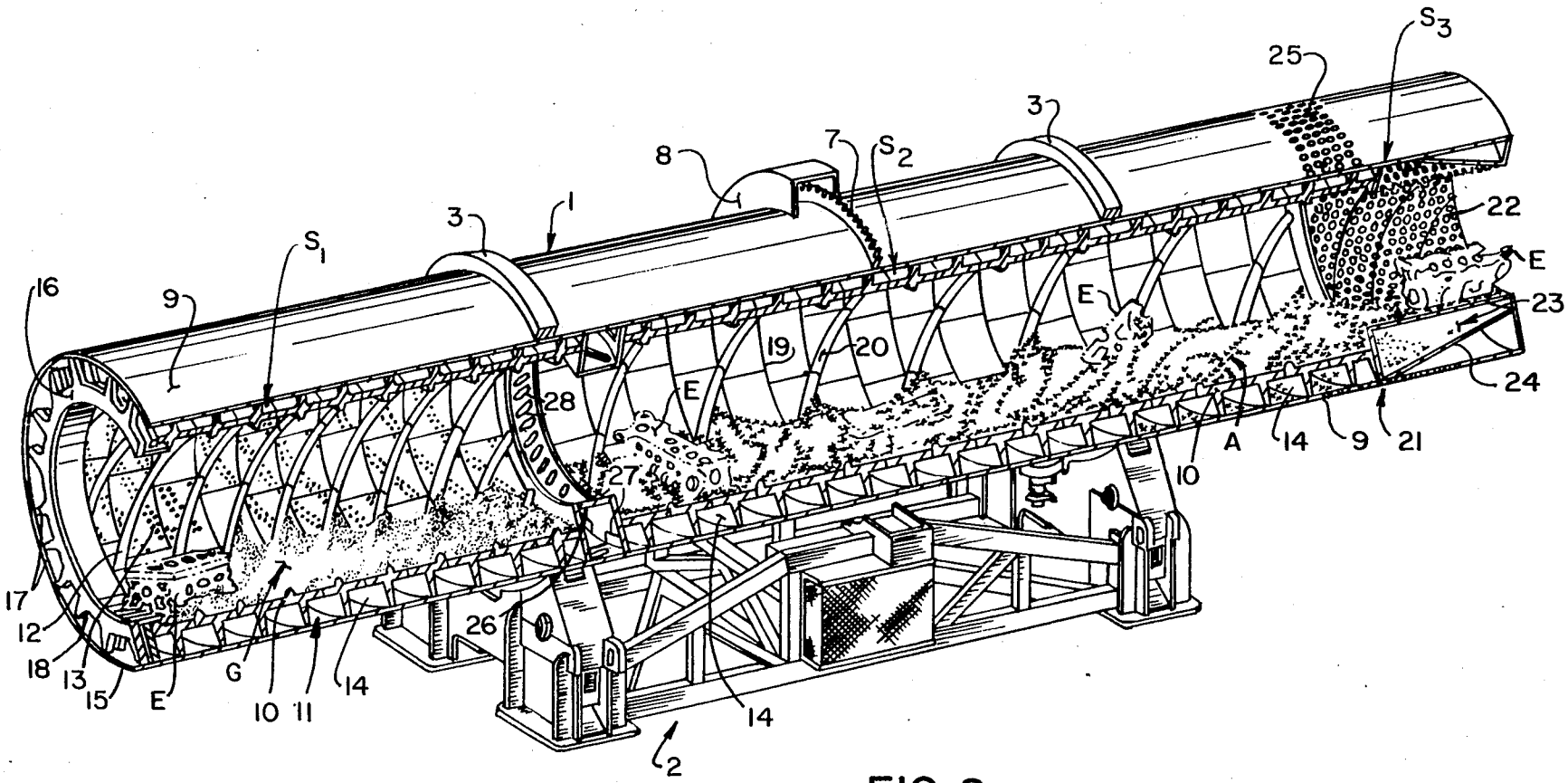
FIG. 2 provides a view similar to FIG. 1, with the drum being partially removed for disclosing its internal structure.
Figure 3:
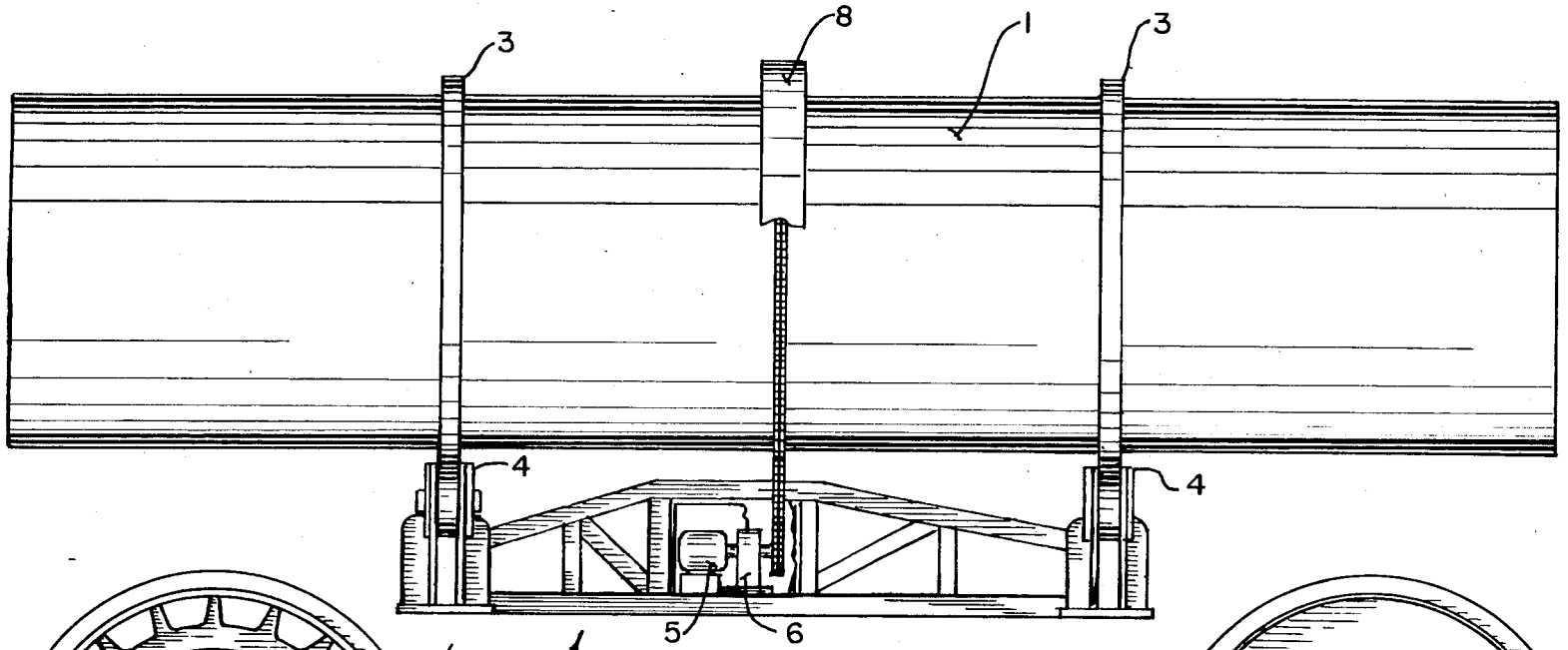
FIG. 3 provides a side view of FIG. 1.
Figure 5:
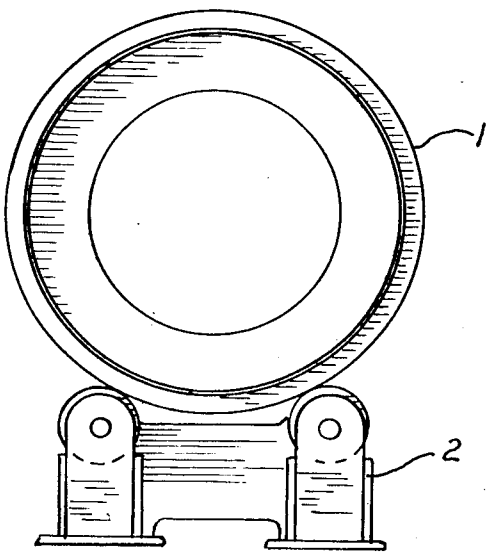
Figure 4:
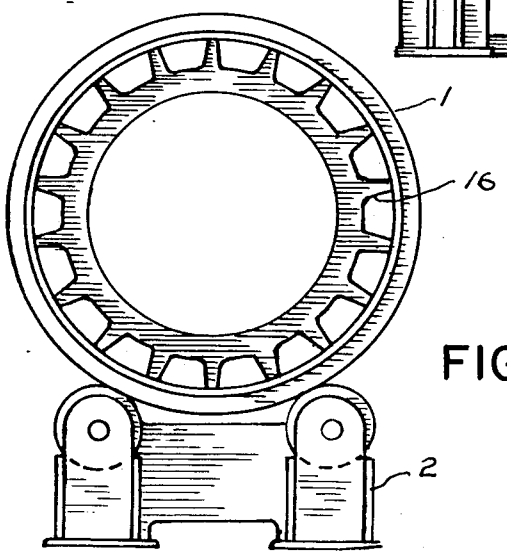
FIG. 4 is an entrance end or left side view of the invention as shown in FIG. 1; and, FIG. 5 is a discharge end or right end view of the invention as shown in FIG. 1.

As can be seen in FIG. 2, the drum means 1 is fabricated of a pair of cylindrical members, such as an outer cylinder 9 and an inner cylinder 10. Generally, there are a series of vanes 11 provided intermediate the spacing formed between these two cylinders, and these vanes are designed for providing for conveyance of any casting sand deposited therein during operations of this apparatus.

As previously summarized, this sand reclaiming unit is useful and highly effective during rotation of the drum means for removing the mold sand from the castings following their manufacture. For example, as can be seen in FIG. 2, engine motor castings E are being cleaned within the apparatus. Within this initial segment $S_1$ of the unit, the surface mold sand or green sand is generally removed from the exterior of the castings through tumbling, and such green sand is generally shown in separation as at G. As this occurs, the castings move gradually longitudinally down the length of the apparatus, through the movement caused by the arrangement of rifling or the like, as at 12, formed upon the surface of the inner cylinder. And the inner cylinder incorporates a series of openings, or perforations, as at 13, and as can be generally seen, in order to allow the reclaimed sand to fall therethrough, into the spacing 11 and therein be urged by operations of these helical vanes 14 in a direction for eventual discharge. In this particular instance, as can be seen, the vanes are angled so as to provide for a shifting of the sand contained within a spacing 11 rearwardly, towards the entrance of the reclaimer, as the drum means 1 rotates in this instance in a counterclockwise direction. Thus, the sand will fall from the entrance end edge 15 of the unit, and therein be collected for reusage, as previously summarized. On the other hand, it is just as likely that the surface of the outer cylinder 9 could be provided with a series of openings, or perforations, or even a screened portion (all of which is not shown), in order to allow for the reclaimed sand to fall at any particular location along its length and be collected for reusage.

It can also be seen that the perforated inner cylinder 10 may be formed of a series of segmented sections, and which are held together in a manner as previously explained and shown in the inventor's U.S. Pat. No. 3,998,262. In addition, a retaining means or ring section 16 is provided at the entrance end of the drum 5, within the inner cylinder 9, and therein provides a means for retention of the inner cylinder 10, or its segmented sections, together, to form a unified inner cylinder surface for operating to separate the green sand from its castings, as previously explained. The retainer ring 16 may incorporate a series of outwardly extending projections 17, and which afford openings, as at 18, therebetween, so as to provide a space through which the green sand may eventually be discharged from the apparatus, after its urging to proximate this end of the drum through the functioning of the helical vanes 14.

The inner cylinder 10 includes a middle segment, as at $S_2$, and within this particular segment the inner cylinder is formed as an annular surface, as at 19, which may likewise be formed of a series of segmented sections, secured together in the manner as previously explained in U.S. Pat. No. 3,998,262. In addition, the segments of the inner cylinder at this location, or within this middle segment, includes a series of rifling, as at 20, to insure the continuing movement of the castings, such as the motor blocks E, therealong, during the rotation of the drum means 1. And, as can also be seen in FIG. 2, the segments of the inner cylinder may be formed integrally, having the rifling 20 formed upon each segment and integrally extending outwardly therefrom may be the helical vanes 14, as previously explained.

Within this middle segment $S_2$ of the reclaimer, there is also deposited an ample quantity of abrasive members, as can be seen at A, and these abrasive members are of the type as previously explained which are available in the art for functioning as means for deburring or cleaning other components. In any event, and also as explained, during the functioning of this middle segment $S_2$ of the reclaimer, these abrasive members A have a tendency to etch their way into the interior of the shifting castings E, and provide a clean out of that core sand normally arranged interiorly thereof and which was required to provide for the interior shaped configuration for the casting during its initial molding. In any event, these abrasive members have a tendency to scrub the interior of the casting, while likewise remove any residual surface green sand that may yet be contained or adhered to the external surface of the casting passing through this apparatus. As the combination castings E, the abrasive members A, and any loosened preferably core sand reach the end, approximately at 21, the combination enters into the third segment $S_3$ of the unit. At this particular location, the inner cylinder of the apparatus is formed as a perforated member, as at 22, providing a series of openings which are obviously too small to allow any casting to pass therethrough, but which allows for the combined abrasive members A and any loosened mold sand to pass through the perforated cylinder, and into the spacing 23 arranged intermediate the inner and outer cylinders. At this juncture, the disposition of an inclined or truncated shaped member 24, in the nature of a plate, is provided therein, and inclines in a direction towards the intermediate section $S_2$, and thereby allows for the back flow of the combined abrasive members and sand towards the spacing arranged intermediate the inner cylinder 10, and the outer cylinder 9, at this location. When this occurs, the sand falls through the grading or screening member 25 formed of a series of perforations provided through the outer cylinder 9, but that the openings provided thereat are too small to allow for the passage of the abrasive members A therethrough. Thus, the abrasive members are picked up by the helical vanes 14, and forced towards the entrance end, or the left end, of the unit as shown in FIG. 2. Thus, the abrasive members are urged the entire length of the intermediate section $S_2$, or until such time as they enter into a formed housing 26 provided between the entrance and intermediate segments $S_1$ and $S_2$ of the reclaimer. This housing is formed as an annulus, as can be seen, having an opening provided therein, with entrance apertures 27 providing for the admission of the abrasive members A into the housing 26, and their eventual falling through the series of apertures 28 provided through the top surface of the housing 26, as can be seen. Thus, at this location, the abrasive members A are deposited once again into the front or leading end of the middle segment $S_2$, where they again combined with any castings deposited within the apparatus and which are moving through the reclaimer during its operation.

As previously explained, the inclined plate or truncated member 24 within the third section $S_3$ of the apparatus is designed to provide for an urging of the combined sand and abrasive members A back towards the middle segment $S_2$. On the other hand, it is just as likely that the inclined plate 24, in addition to the adjacent surface of the outer cylinder 9, within the formed section $S_3$, could be perforated, and allow the core sand to fall therethrough, and be collected at that location, rather than slightly forwardly thereof, as shown through the perforated section 25 formed at the discharge end of the middle section $S_2$, as disclosed. In any event, and regardless of where the perforations 25 may be located, whether they be at the position as shown at the end of the middle section $S_2$, are entirely or partially through the outer cylinder 9 within the third section $S_3$, it is desired that this core sand be collected, for ready cleaning, retreatment, and for reusage for forming those internal mold segments for any future casting to be formed.

It might be commented that during the operations of this particular invention the drum means will normally be rotated at a velocity of approximately a fraction or to a plurality of revolutions per minute, but that this rotation for the combined cylinders can be varied, depending upon the type of castings being cleaned, and the size and weight of these cast members. Obviously, when motor blocks as at E are being cleaned, the revolutions of the drum means will be slowed considerably. In the construction of a prototype of this development, to give an example of the type of dimensions that may be used in one embodiment, as for example that which may be designed for removing mold sand from motor blocks, the unit may be approximately twenty-four feet in length, the outer cylinder may have an outside diameter of approximately forty-eight inches, while the inner cylinder has a diameter of approximately thirty-nine inches. The various perforations provided within or through the drum means should be of sufficient dimensions so as to allow for the passage of the identified materials therethrough. For example, the perforations provided within the inner cylinder 10 of the segment $S_1$, in addition to the perforations 25, of the outer cylinder 9, should be of sufficient size so as to allow passage of the molding sand therethrough. Furthermore, the perforations 22 formed through the inner cylinder of the discharge segment $S_3$ should be of sufficient dimension so as to allow the combined passage of the star media G in combination with the mold sand therethrough, and generally these dimensions will be in the order of approximately one to three inches, or greater or smaller, generally depending upon the size of the media G used for scrubbing the inner arranged cavities of the castings E being cleaned. Obviously, these dimensions will vary depending upon the size of castings being treated. In any event, and regardless what speed or size of unit is used, this reclaimer device is highly effective for providing for the reasonably discrete separation of the differing sands, such as the green mold sand or the core sand from their castings, with each sand being substantially collected separately, and for ready repreparation for a usage again in the molding process.

Variations or modifications to the structure and operation of this invention may occur to those skilled in the art upon reviewing the invention as shown and described herein. Such variations or modifications, if within the spirit of this invention, are intended to be encompassed within the scope of any claims to patent protection issuing herein. The description of the preferred embodiment set forth herein is done so for illustrative purposes only.

Having thus described the invention what is claimed and desired to be secured by Letters Patent is:

1. A dual sand reclaimer for use for removal of the normally inaccessible clinging mold casting sand from a molded cast iron part, comprising, a rotary drum, a base means supporting the drum for a slow speed of rotation, bearing means provided upon the base means and supporting the drum during said rotation, drive means provided with the base means and furnishing the drum with its slow speed of rotation, said rotary drum comprised of a pair of cylinders, one cylinder being an outer cylinder, the other cylinder being an inner and concentric cylinder of the outer cylinder, there being a spacing provided between the two said cylinders, a series of helically arranged vanes provided at least partially between the two arranged cylinders and within the spacing, said drum being formed of three segments, the first segment being an entrance segment provided for the entrance of the castings therein and effecting removal of the surface disposed mold sand therefrom during tumbling of the castings, the entrance segment of the inner cylinder having means provided therewith for moving the castings longitudinally therealong, the entrance segment of the inner cylinder having openings provided therethrough for passage of the removed sand to the spacing, said vanes thereat providing for movement of the sand for disposition, the middle segment of the inner cylinder having means provided therewith for moving the castings longitudinally therealong, said middle segment of the inner cylinder being provided for accommodating a supply of abrasive members that aid in the removal of the mold sand from the inner areas of any casting tranversing therealong, the third segment of the inner cylinder having a series of openings therethrough and providing for the separation of the loosened sand and the abrasive members from the casting and with the sand and members passing into the spacing between the two said cylinders while said castings are discharged from the drum, means provided between the cylinders within the third segment for moving the abrasive members towards the spacing between the cylinders within the middle segment for a return to the entrance segment of the inner cylinder while effecting a disposition of the middle segment loosened sand from the drum.

2. The invention of claim 1 and wherein said middle segment of the inner cylinder has a leading end and discharging end, vanes between of the inner and outer cylinders in the middle segment for moving said abrasive members to approximately the leading end of the middle segment and for discharge back into the middle segment of the inner cylinder for reusage.

3. The invention of claim 2 and including a housing means arranged intermediate the first and middle segments of the inner cylinder and proximate the leading end of the middle segment, said housing having openings communicating with the space between the middle segment of the inner and outer cylinders and disposed for receiving therein the abrasive members returned by the vanes, and said housing having further openings for discharging the members onto of the middle segment of the inner cylinder for reusage.

4. The invention of claim 1 and including a retaining means holding said inner cylinder at the entrance segment within the outer cylinder, and said retaining means having openings provided therethrough.

5. The invention of claim 4 and wherein said retaining means comprises a ring means, said ring means including a series of projections arranged in proximity with the outer cylinder and providing openings between the said projections for disposition of sand.

6. The invention of claim 4 and wherein the first segment of the inner cylinder is sectionalized.

7. The invention of claim 1 and wherein means for effecting a disposal of the middle segment loosened sand from the drum, said means comprising a series of openings in the outer cylinder for discharge of the sand while retaining the abrasive members.

8. The invention of claim 7 and wherein the means provided between the cylinders within the third segment for moving the abrasive members comprises an inclined member sloped to direct the members towards the spacing within the middle segment.

9. The invention of claim 8 and wherein said inclined member has a series of openings therethrough for passage of sand while retaining the abrasive members thereon for movement towards the spacing between the inner and outer cylinders in the middle segment.

10. The invention of claim 1 and wherein said means for moving the castings longitudinally along the entrance and middle segments of the inner cylinder.

11. In the process for loosening and removing sand from the normally inaccessible areas of cast iron parts and reclaiming the sand, comprising, providing a drum means with a degree of rotation, formed of an inner and outer cylinder, providing said drum means with an entrance, middle and discharge segments, introducing castings having surface sand thereon into the entrance segment of the drum means wherein the castings are moved longitudinally along the rotating drum means, while causing loosening and removal of sand from the casting and passage thereof through perforations formed within the inner cylinder provided within the entrance segment of the rotating drum means, passing said castings further along said rotating drum means and into its middle segment, tumbling said castings therein while moving them longitudinally along said middle segment, while exposing the castings to a core sand loosening media for removing core sand from within internal cavities formed within the moving castings, further passing said castings, loosened core sand, and abrasive media towards and into the discharge segment of the rotating drum means, discharging the castings from the end of the apparatus, while screening for a separation of the abrasive media from the loosened core sand, discharging for collection the loosened core sand while passing the abrasive media intermediate the inner and outer cylinders forming the middle section of the drum means for transfer back to the said middle segment and for their deposition therein for further cleaning of additional castings.

* * * * *

UNITED STATES PATENT AND TRADEMARK OFFICE

CERTIFICATE OF CORRECTION

PATENT NO. : 4,674,691

DATED : June 23, 1987

INVENTOR(S) : Charles J. Didion

It is certified that error appears in the above-identified patent and that said Letters Patent is hereby corrected as shown below:

Claim 10, line 13, insert at the end of the sentence, and before the period -- comprises rifling --.

Signed and Sealed this

Eighth Day of December, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,674,691

DATED : June 23, 1987

INVENTOR(S) : Charles J. Didion

It is certified that error appears in the above-identified patent and that said Letters Patent is hereby corrected as shown below:

Claim 1, line 66, change "tranversing" to --traversing--.

Claim 2, line 13, delete the "of".

Claim 3, line 26, delete "of", first occurrence.

Signed and Sealed this

Twenty-third Day of February, 1988

*Attest:*

DONALD J. QUIGG

*Attesting Officer*

*Commissioner of Patents and Trademarks*